United States Patent [19]

Von Hoene et al.

[11] 4,123,269

[45] Oct. 31, 1978

[54] ELECTROSTATOGRAPHIC PHOTOSENSITIVE DEVICE COMPRISING HOLE INJECTING AND HOLE TRANSPORT LAYERS

[75] Inventors: Donald C. Von Hoene; Joseph Y. C. Chu, both of Fairport; Inan Chen, Webster; Robert N. Jones, Fairport, all of N.Y.

[73] Assignee: Xerox Corporation, Stamfod, Conn.

[21] Appl. No.: 837,666

[22] Filed: Sep. 29, 1977

[51] Int. Cl.[2] ..... G03G 5/04

[52] U.S. Cl. ..... 96/1 PC; 96/1.5 N

[58] Field of Search ..... 96/1.5, 1 PC, 1

[56] References Cited

U.S. PATENT DOCUMENTS 4,047,948 9/1977 Horgan ..... 96/1.5

*Primary Examiner*—John D. Welsh

[57] ABSTRACT

Disclosed is a layered photosensitive device for use in electrostatographic copying. The device comprises:

(a) an electrically conductive substrate;

(b) a layer of material capable of injecting holes into a layer on its surface;

(c) a hole transport layer in operative contact with the layer of hole injecting material which transport layer comprises a combination of a highly insulating organic resin having dispersed therein small molecules of an electrically active material, the combination of which is substantially non-absorbing to visible light but allows injection of photogenerated holes fom a charge generator layer in contact with said hole transport layer and electrically induced holes from the layer of injecting material;

(d) a layer of a charge generating photoconductive material on and in operative contact with the charge transport layer; and (e) a layer of an insulating organic resin overlaying the layer of charge generating material.

14 Claims, 8 Drawing Figures

ELECTROSTATOGRAPHIC PHOTOSENSITIVE DEVICE COMPRISING HOLE INJECTING AND HOLE TRANSPORT LAYERS

BACKGROUND OF THE INVENTION

This invention relates to electrostatographic copying and more particularly to a novel electrostatographic photosensitive device. The art of xerography, as originally disclosed in U.S. Pat. No. 2,297,691 by C. F. Carlson, involves the formation of an electrostatic latent image on the surface of a photosensitive plate normally referred to as the photoreceptor. The photoreceptor comprises a conductive substrate having on its surface a layer of a photoconductive insulating material. Normally, there is a thin barrier layer between the substrate and the photoconductive layer to prevent charge injection from the substrate into the photoconductive layer upon charging of the plate's surface.

In operation, the plate is charged in the dark, such as by exposing it to a cloud of corona ions, and imaged by exposing it to a light shadow image to selectively discharge the photoreceptor and leave a latent image corresponding to the shadow areas. The latent electrostatic image is developed by contacting the plate's surface with an electroscopic marking material known as toner which will adhere to the latent image due to electrostatic attraction. Transfer of the toner image to a transfer member such as paper with subsequent fusing of the toner into the paper provides a permanent copy.

One type of electrostatographic photoreceptor comprises a conductive substrate having a layer of photoconductive material on its surface which is overcoated with a layer of an insulating organic resin. Various methods of imaging this type of photoreceptor are disclosed by Mark in his article appearing in *Photographic Science and Engineering*, Vol. 18, No. 3, pgs. 254–261, May/June 1974. The processes referred to by Mark as the Katsuragawa and Canon processes can basically be divided into four steps. The first is to charge the insulating overcoating. This is normally accomplished by exposing it to d.c. corona of a polarity opposite to that of the majority charge carrier. When applying a positive charge to the surface of the insulating layer, as in the case where an n-type photoconductor is employed, a negative charge is induced in the conductive substrate, injected into the photoconductor and transported to and trapped at the insulating layer-photoconductive layer interface resulting in an initial potential being solely across the insulating layer. The charged plate is then exposed to a light and shadow pattern while simultaneously applying to its surface an electronic field of either alternating current (Canon) or direct current of polarity opposite that of the initial electrostatic charge (Katsuragawa). The plate is then uniformly exposed to activating radiation to produce a developable image with potential across the insulating overcoating and simultaneously reduce the potential across the photoconductive layer to zero. In other processes described in the Mark article, i.e. the Hall and Butterfield processes, the polarity of the initial voltage is the same sign as the majority charge carrier and reverse polarity is encountered during erase.

In processes where the voltages must initially be placed across the overcoating, for example, in step 1 of the Canon process, either an injecting contact for the majority carrier or the ability to bulk generate carriers or an ambipolar photoconducting layer must be used. In processes where the initial voltage polarity is the opposite sign of the majority carrier, there is required an injecting contact for the majority carrier, the ability to bulk generate carriers or an ambipolar photoconducting layer.

It is an object of the present invention to provide a novel electrostatographic photosensitive device having a layer of an insulating organic resin on its surface.

A further object is to provide such a device which has mechanical flexibility and can be easily fabricated at a moderate cost.

An additional object is to provide such a device which provides mechanical, chemical and electrical protection for the electrically active components.

Another object is to provide such a device with improved dark injection efficiency.

SUMMARY OF THE INVENTION

The present invention is a layered photosensitive device for use in electrostatographic copying which comprises from the bottom up:

(a) an electrically conductive substrate;

(b) a layer of material capable of injecting holes into a layer on its surface;

(c) a hole transport layer in operative contact with the layer of hole injecting material which transport layer comprises a combination of an electrically inactive organic resin having dispersed therein an electrically active material, the combination of which is substantially non-absorbing to visible electromagnetic radiation but allows the injection of photogenerated holes from a charge generator layer in contact with said hole transport layer and electrically induced holes from the layer of injecting material;

(d) a layer of a charge generating material on and in operative connection with the charge transport layer; and (e) a layer of an insulating organic resin overlaying the layer of charge generating material.

DETAILED DESCRIPTION

Figure 1:
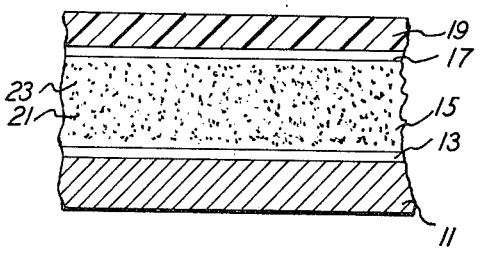

The present invention is a novel, overcoated, electrostatographic photoreceptor which can be fabricated in a flexible belt form on a plastic film base and is potentially capable of providing a very long life, panchromaticity and high speed. The device's structure, illustrated by FIG. 1, comprises a conductive substrate 11 having a layer of hole injecting material 13 on its surface which is in turn overcoated with a layer of hole transport material 15. The charge transport layer has a thin layer of photoconductive charge generating material 17 on its surface which is in turn overcoated with a relatively thick layer of an insulating organic resin 19.

The injecting layer 13 and charge generator layer 17 should be capable of injecting charge carriers into the transport layer under the influence of an electric field, the former in the dark and the latter when excited by light. The sign of the charge carriers injected should match that of the dominant carriers in the transport layer, i.e. positive in the present situation. The interface between charge generating layer 17 and insulating resin 19 should be capable of trapping charges during the dark charging step.

The transport layer in a preferred embodiment comprises molecules of the formula:

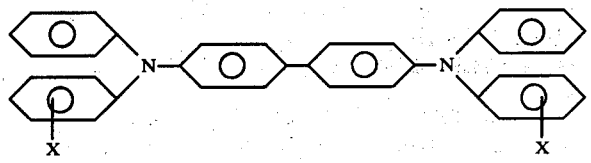

dispersed in a highly insulating organic resin. This charge transport layer, which is described in detail in copending application Ser. No. 716,403 (series of 1970) filed by Milan Stolka et al. on Aug. 23, 1976, is substantially non-absorbing in the spectral region of intended use, i.e. visible light, but is "active" in that it allows injection of photogenerated holes from the charge generator layer and electrically induced holes from the injecting interface. The highly insulating resin, which has a resistivity of at least $10^{12}$ ohms-cm to prevent undue dark decay, is a material which is not necessarily capable of supporting the injection of photogenerated holes from the injecting or generator layer and is not capable of allowing the transport of these holes through the material. However, the resin becomes electrically active when it contains from about 10 to 75 weight percent of the substituted N,N,N',N'-tetraphenyl-[1,1'-biphenyl]4,4'-diamines corresponding to the foregoing formula. Compounds corresponding to this formula may be named N,N'-diphenyl-N,N'-bis(alkylphenyl)-[1,1'-biphenyl]-4,4'-diamine wherein the alkyl is selected from the group of 2-methyl, 3-methyl and 4-methyl. In the case of chloro substitution, the compound is called N,N'-diphenyl-N,N'-bis(halo phenyl)-[1,1'-biphenyl]-4,4'-diamine wherein the halo atom is 2-chloro, 3-chloro or 4-chloro.

The charge transport layer 15 comprises a transparent, electrically inactive organic resinous material having dispersed therein from about 10 to 75 percent by weight of a substituted N,N,N',N'-tetraphenyl-[1,1'-biphenyl]-4,4'-diamine which can be N,N'-diphenyl-N,N'-bis(2-methylphenyl)-[1,1'-biphenyl]-4,4'-diamine; N,N'-diphenyl-N,N'-bis(3-methylphenyl)-[1,1'-biphenyl]-4,4'-diamine; N,N'-diphenyl-N,N'-bis(4-methylphenyl)-[1,1'-biphenyl]-4,4'-diamine; N,N'-diphenyl-N,N'-bis(2-chlorophenyl)-[1,1'-biphenyl]-4,4'-diamine; N,N'-diphenyl-N,N'-bis(3-chlorophenyl)-[1,1'-biphenyl]-4,4'-diamine and N,N'-diphenyl-N,N'-bis(4-chlorophenyl)-[1,1'-biphenyl]-4,4'-diamine. The addition of the substituted N,N,N',N'-tetraphenyl-[1,1'-biphenyl]-4,4'-diamine to the electrically inactive organic resinous material forms the charge transport layer which is capable of supporting the injection of photogenerated holes from the injecting layer or the photogenerating layer The thickness of the transport layer is typically from about 20 to 40 microns, but thicknesses outside this range may be used. The preferred electrically active material has been described in detail. Other electrically active small molecules which can be dispersed in the electrically inactive resin to form a layer which will transport holes include triphenylmethane, bis-(4-diethylamino-2-methylphenyl) phenylmethane; 4',4''-bis(diethylamino)-2',2''-dimethyltriphenyl methane; bis-4(-diethylamino phenyl) phenylmethane; and 4,4'-bis(diethylamino)-2,2'-dimethyltriphenylmethane.

Transport layer 15 may comprise any transparent electrically inactive resinous material such as those described by Middleton et al. in U.S. Pat. No. 3,121,006. The resinous binder contains from 10 to 75 weight percent of the active material corresponding to the foregoing formula and preferably from about 40 to about 50 weight percent of this material. Typical organic resinous materials useful as the binder include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binder materials are polycarbonate resins having a molecular weight ($M_w$) of from about 20,000 to about 100,000 with a molecular weight in the range of from about 50,000 to about 100,000 being particularly preferred.

Figure 2D:
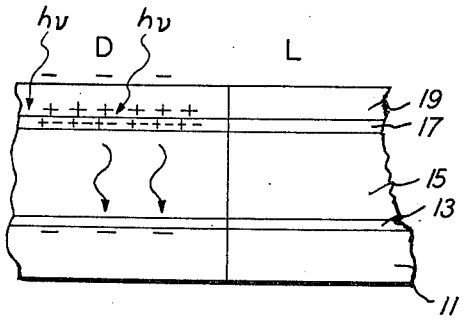
Figure 2A:
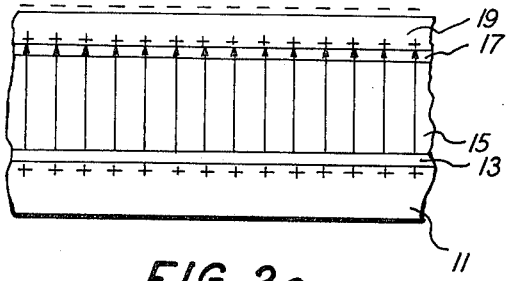
Figure 2E:
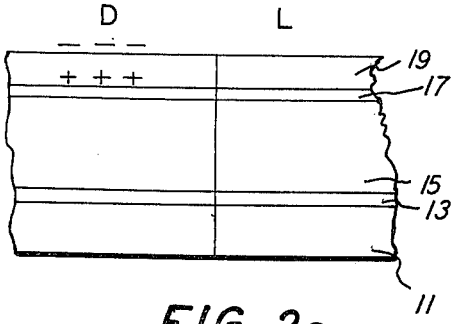

The charge injecting layer 13 lies between the transport layer 15, and substrate 11 and serves the function of injecting holes into the transport layer when an electrostatic charge is applied to the surface of the device. Referring to FIG. 2*a* there is illustrated the results of application of a negative charge to the device. Upon such charging, holes are induced from the substrate to the substrate/injection layer interface and then injected into the transport layer where they migrate to the insulator layer/charge generator layer interface to produce an electronic field across the insulator layer. Typical of charge injecting materials are gold and graphite. In certain configurations, such as where a nickel substrate is used, the conductive substrate forms an injecting interface with the layer of hole transport material and no separate injecting layer is needed.

The conductive substrate upon which the layer of injecting material is deposited can be made up of any suitable conductive material. It may be rigid as in the case where a flat plate or drum configuration is employed, but must, of course, be flexible for use in the endless belt configuration of some photoreceptors. In this configuration, a continuous, flexible, nickel belt or a web or belt of a metallized polymer such as aluminized Mylar can be conveniently used.

The injecting interface is applied to the substrate, such as by vapor deposition in the case of gold, and solvent deposition in the case of graphite, to a thickness typically in the range of from about 0.1 to 5 microns. The transport layer is deposited over the charge injecting layer, typically by solvent coating techniques.

Figure 2B:
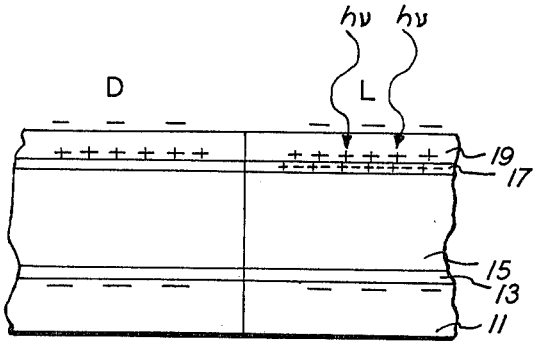

After the initial charging of the photosensitive device, it is secondarily charged with positive d.c. or positively biased a.c. corona and simultaneously imagewise illuminated to provide zero device surface potential as illustrated by FIG. 2*b*. In this figure, the charge distribution is drawn assuming equal capacitance values for the insulating overcoating and the photogenerator/-transport layer/interface combination.

Figure 2C:
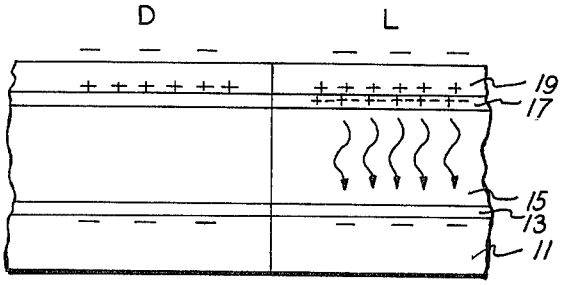

The charge generating photoconductive material is deposited onto the exposed surface of the charge transport layer. The generator layer photogenerates charge carriers (electron-hole pairs) and injects holes into the hole transport layer. This is illustrated by FIG. 2*c* wherein the right side of the structure represents the exposed portion and the left side represents the unexposed portion. Suitable photoconductive charge generating materials include trigonal selenium, selenium/tellurium alloys, $As_2Se_3$, amorphous selenium, organic photoconductors, such as phthalocyanine and other organic dyes capable of photogenerating charge carriers. The charge generating layer is typically applied to a thickness of from 0.1 to 5 microns with a thickness of from 0.2 to 3 microns being preferred.

The insulating resin which constitutes the top layer of the photoreceptor of the instant invention can be any organic resin which has high resistance against wear, high resistivity and the capability of binding electrostatic charge together with translucency or transparency to activating radiation. Examples of resins which may be used are polystyrene, acrylic and methacrylic polymers, vinyl resins, alkyd resins, polycarbonate resins, polyethylene resins and polyester resins. The insulating layer will be at least about 10 microns in thickness with a layer in the range of from about 20 to 50 microns being typical.

The operation of the device is illustrated by FIGS. *2a–e*. In one method of forming a latent image on the surface of the device, it is initially charged using a corotron of negative polarity. The next step is to secondarily charge the device using a corotron of opposite polarity and simultaneously imagewise expose the device which is illustrated by FIG. *2b*. The result of the imaging process is illustrated by FIG. *2c* wherein the right side of the device is depicted as having been exposed to sufficient light to completely discharge the device and the left side remains in shadow. After imagewise exposure, the device is flood illuminated. As illustrated by FIGS. *2d* and *2e*, the effect of flood illumination is to form a developable contrast potential across the layer of insulating material.

The present invention is further illustrated by the following example.

EXAMPLE I

A photosensitive device according to the present invention is prepared as follows:

A thin 0.2μ layer of gold is vacuum deposited onto an aluminum substrate to provide a hole injecting interface. A 30μ transport layer of 50 weight percent small molecule N,N'-diphenyl-N,N'-bis(4-methylphenyl)-[1,1'-biphenyl]-4,4'-diamine dispersed in Makrolon polycarbonate is solvent coated over the gold injecting layer. A 3μ charge generator layer comprising 40 volume percent particulate trigonal selenium dispersed in a 60 volume percent poly(vinylcarbazole) is applied over the charge transport layer by solvent deposition techniques. A 25μ thick layer of Mylar polyester is applied over the charge generator layer by lamination to serve as the insulating overcoating.

Figure 4:
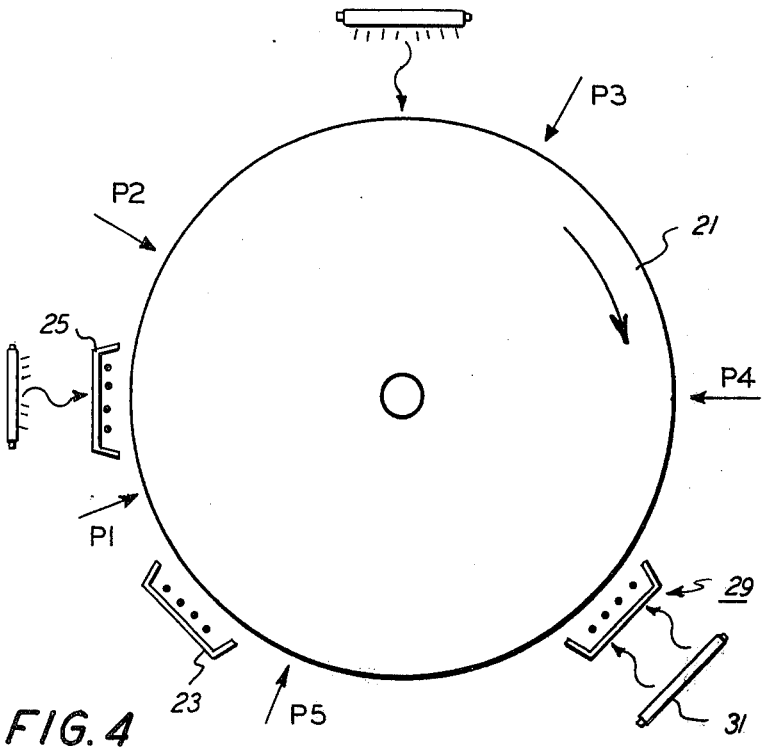
Figure 3:
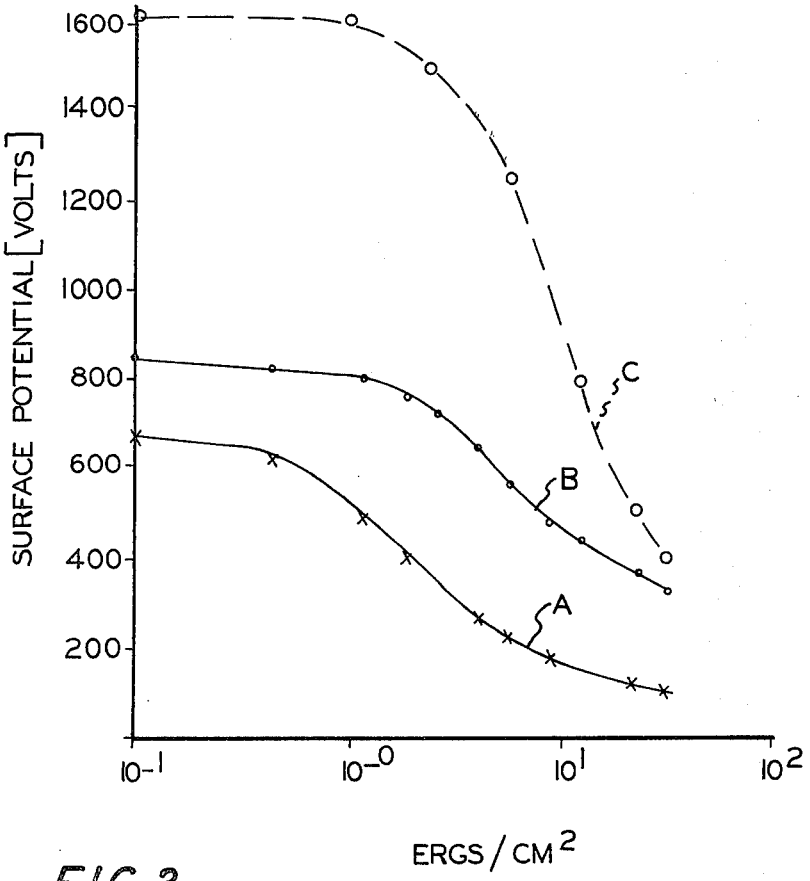

FIG. 3 represents xerographic discharge curves prepared using the experimental set-up depicted in FIG. 4. In FIG. 4 drum 21 is rotated in a clockwise direction past charging corotron 23, exposure station 25 (which comprises means for simultaneously imagewise exposing and secondarily charging the photosensitive device), flood illumination station 27 and erasure station 29. The imagewise exposure station is equipped with a xenon lamp and a biased a.c., 60 $H_z$, ~ 7. KV RMS, +500 volt d.c. bias corotron whereas the erasure corotron comprises a 400 $H_z$, ~ 7. KV RMS, +500 volt d.c. bias corotron.

Curve A was generated using a standard xerographic set-up of positive charge, expose and erase. Positive charging was used in this experiment because of the high positive carrier mobility and photogeneration at the top of the device. Five voltage measurements could be made using probes (indicated as $P_1$, $P_2$, $P_3$, $P_4$ and $P_5$ in FIG. 4). The data plotted in FIG. 3 are from probe 4 ($P_4$). For these data the shunt device at exposure is turned off and erase was accomplished with a tungsten lamp.

The data for curves B and C were generated using the charge, imagewise expose and simultaneous recharge, flood and erase process previously described. In this set-up the device surface potential is shunted to zero volts at exposure station 25 as measured by $P_2$. The initial charging was negative, i.e. opposite to the sign of the majority charge carrier in these experiments. The data for curves B and C are negative potentials and obtained after flood illumination. Erasure was carried out using a simultaneous expose/shunt device.

All three curves exhibit high development potential which correspond to high development fields. The data can be generated in a cyclic fashion without residual voltage buildup as determined by measurement at $P_5$ and the maintenance of large development potentials.

What is claimed is:

1. A layered photosensitive device for use in electrostatographic copying which comprises from the bottom up:

(a) an electrically conductive substrate;

(b) a layer of material capable of injecting holes into a layer on its surface, this material being selected from the group consisting of gold and graphite;

(c) a hole transport layer in operative contact with the layer of hole injecting material which transport layer comprises a combination of a highly insulating organic resin having dispersed therein small molecules of an electrically active material, the combination of which is substantially non-absorbing to visible light but allows injection of photogenerated holes from a charge generator in contact with said hole transport layer and electrically induced holes from the layer of injecting material;

(d) a layer of a charge generating photoconductive material on and in operative contact with the charge transport layer; and (e) a layer of an insulating organic resin overlaying the layer of charge generating material.

2. The device of claim 1 wherein the electrically active material dispersed in the insulating organic resin is a nitrogen containing composition of the formula:

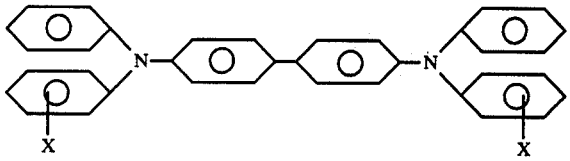

wherein X is (ortho) $CH_3$, (meta) $CH_3$, (para) $CH_3$, (ortho) Cl, (metal) Cl or (para) Cl.

3. The device of claim 2 wherein the hole transport layer contains from about 10 to 75 weight percent of the nitrogen containing composition.

4. The device of claim 1 wherein the hole transport layer contains from about 40 to 50 weight percent of the electrically active composition.

5. The device of claim 2 wherein the hole transport layer contains from about 40 to 50 weight percent of the nitrogen containing composition.

6. The device of claim 1 wherein the hole transport layer is from 20 to 40 microns in thickness.

7. The device of claim 1 wherein the highly insulating organic resin in the hole transport layer is a polycarbonate, an acrylate polymer, a vinyl polymer, a cellulose polymer, a polyester, a polysiloxane, a polyamide, a polyurethane or an epoxy.

8. The device of claim 7 wherein the organic resin is a polycarbonate having a molecular weight of from about 20,000 to about 100,000.

9. The device of claim 1 wherein the charge generating material is trigonal selenium, a selenium/tellurium alloy, $As_2Se_3$, amorphous selenium or phthalocyanine.

10. The device of claim 1 wherein the charge generating layer is from 0.1 to 5 microns in thickness.

11. The device of claim 1 wherein the charge generating layer is from 0.2 to 3 microns in thickness.

12. The device of claim 1 wherein the layer of insulating resin overlaying the layer of charge generating material is from 20 to 50 microns in thickness.

13. The device of claim 1 wherein the electrically conductive substrate is capable of injecting holes into its surface and no separate injecting layer is employed.

14. The device of claim 13 wherein the conductive substrate is made of nickel.

* * * * *